US006293977B1

(12) United States Patent
Caprotti et al.

(10) Patent No.: US 6,293,977 B1
(45) **Date of Patent: *Sep. 25, 2001**

(54) LUBRICITY ADDITIVES FOR FUEL OIL COMPOSITIONS

(75) Inventors: Rinaldo Caprotti; Christophe Ledeore, both of Oxfordshire (GB)

(73) Assignee: Exxon Chemical Patents Inc., Linden, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/158,374

(22) Filed: Sep. 22, 1998

(30) Foreign Application Priority Data

Sep. 22, 1997 (GB) ..... 9720102

(51) Int. Cl.[7] ..... C10L 1/18
(52) U.S. Cl. ..... 44/389; 44/398

(58) Field of Search ..... 44/398, 386

(56) References Cited

U.S. PATENT DOCUMENTS

| | | | | |
|---|---|---|---|---|
| 3,240,575 | * | 3/1966 | Miller et al. | 44/398 |
| 3,273,981 | | 9/1966 | Furey . | |
| 3,287,273 | | 11/1966 | Furey et al. . | |
| 3,346,354 | * | 10/1967 | Kautsky et al. | 44/398 |
| 3,429,817 | * | 2/1969 | Furey et al. | 44/398 |
| 3,632,510 | * | 1/1972 | LeSuer | 44/398 |
| 5,266,084 | | 11/1993 | Baillargeon et al. | 44/393 |

FOREIGN PATENT DOCUMENTS

| | | |
|---|---|---|
| 1 231 185 | 5/1971 | (GB) . |
| 1 552 280 | 9/1979 | (GB) . |
| WO 94/06896 | 3/1994 | (WO) . |
| WO 94/17160 | 8/1994 | (WO) . |

* cited by examiner

*Primary Examiner*—Margaret Medley

(57) ABSTRACT

Products formed from polycarboxylic acids and epoxides form useful lubricity additives.

3 Claims, No Drawings

LUBRICITY ADDITIVES FOR FUEL OIL COMPOSITIONS

This invention relates to additives for improving the lubricity of fuel oils such as diesel fuel oil. Fuel oil compositions including the additives of this invention exhibit improved lubricity and reduced engine system wear.

Concern for the environment has resulted in moves to significantly reduce the noxious components in emissions when fuel oils are burnt, particularly in engines such as diesel engines. Attempts are being made, for example, to minimise sulphur dioxide emissions. As a consequence attempts are being made to minimise the sulphur content of fuel oils. For example, although typical diesel fuel oils have in the past contained 1% by weight or more of sulphur (expressed as elemental sulphur) it is now considered desirable to reduce the level to 0.2% by weight, preferably to 0.05% by weight and, advantageously, to less than 0.01% by weight, particularly less than 0.001% by weight.

Additional refining of fuel oils, necessary to achieve these low sulphur levels, often results in reductions in the level of polar components. In addition, refinery processes can reduce the level of polynuclear aromatic compounds present in such fuel oils.

Reducing the level of one or more of the sulphur, polynuclear aromatic or polar components of diesel fuel oil can reduce the ability of the oil to lubricate the injection system of the engine so that, for example, the fuel injection pump of the engine fails relatively early in the life of an engine. Failure may occur in fuel injection systems such as high pressure rotary distributors, in-line pumps and injectors. The problem of poor lubricity in diesel fuel oils is likely to be exacerbated by the future engine system developments aimed at further reducing emissions, which will have more exacting lubricity requirements than present engines. For example, the advent of high pressure unit injectors is anticipated to increase the fuel oil lubricity requirement.

Similarly, poor lubricity can lead to wear problems in outer areas of the engine system or in other mechanical devices dependent for lubrication on the natural lubricity of fuel oil. Lubricity additives for fuel oils have been described in the art. WO 94/17160 describes an additive which comprises an ester of a carboxylic acid and an alcohol wherein the acid has from 2 to 50 carbon atoms and the alcohol has one or more carbon atoms. Glycerol monooleate is specifically disclosed as an example. Acids of the formula "$R^1$(COOH)", wherein $R^1$ is an aromatic hydrocarbyl group are generically disclosed by not exemplified.

U.S. Pat. No. 3,273,981 discloses a lubricity additive being a mixture of A+B wherein A is a polybasic acid, or a polybasic acid ester made by reacting the acid with C1–C5 monohydric alcohols; while B is a partial ester of a polyhydric alcohol and a fatty acid, for example glycerol monooleate, sorbitan monooleate or pentaerythritol monooleate. The mixture finds application in jet fuels.

U.S. Pat. No. 3,287,273 describes lubricity additives which are reaction products of a dicarboxylic acid and an oil-insoluble glycol. The acid is typically predominantly a dimer of unsaturated fatty acids such as linoleic or oleic acid, although minor proportions of the monomer acid may also be present. Alkane diols or oxa-alkane diols are primarily suggested as the glycol reactant. Example 7 discloses the reaction of one molar proportion of a dioic acid with 0.01 to 0.75 molar proportion of ethylene or propylene oxide.

UK 1,231,185 discloses a process for the preparation of β-hydroxy alkyl and aralkyl esters of unsaturated aliphatic dicarboxylic acids by reaction with vicinal epoxides of the general formula:

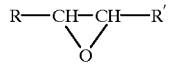

wherein R and R' are each hydrogen, alkyl or aryl. The specific disclosure regarding the dicarboxylic acid reactant is limited to maleic, fumaric, glutaconic and 2-methylene alkane dicarboxylic acids such as itaconic acid and 2-methylene glutaric acid.

UK 1,552,280 discloses polycarboxylic acid -2-hydroxyalkyl esters and the use thereof as emulsifying agents in cosmetic emulsions. The esters have the general formula $(—COOH)_n$

A

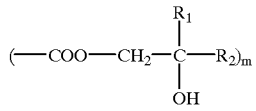

wherein A represents an alkyl, cycloalkyl or aryl radical which is optionally substituted or interrupted by heteroatoms, $R_1$, represents hydrogen or an alkyl radical having 1 to 12 carbon atoms, and $R_2$ represents an alkyl radical having 12 to 22 carbon atoms, $n \geqq 0$ and $m \geqq 2$, with the proviso that $m \geqq n$ and the total of $n+m \geqq 3$. The esters are manufactured by reacting the corresponding carboxylic acid and epoxide.

WO-A-94 06896 discloses oligomeric or polymeric reaction products of aromatic anhydrides and epoxides of the type $(\text{-A-B})_n$ wherein n is equal to or greater than 1. The additives are described as improving the low temperature properties of distillate fuels.

U.S. Pat. No. 5,266,084 similarly concerns low temperature flow improvers for distillate fuels which may be formed from the alkenyl anhydrides or diacid equivalents and long-chain epoxides or diol equivalents. $C_{18}$ to $C_{24}$ alylated succinic anhydride is quoted as an example of the anhydride reactant.

There exists in the art a continual need for lubricity additives showing enhanced performance over existing materials, due not only to the development of engines with more exacting requirements, but also to the general demand from consumers and fuel producers for higher quality fuels.

In addition, there is a desire for additives to be handleable without the need for special operating measures. The extent to which an additive solidifies at lower ambient temperature (e.g. via crystallisation) determines the extent to which an additive may be handled in the absence of heating and mixing procedures. Many conventional additives require substantial mixing and heating prior to addition to the fuel, and such operations can cause processing delays and may make the use of such additives uneconomic in spite of their performance-enhancing effects.

SUMMARY OF THE INVENTION

In has not been found that certain products obtainable by the reaction of polycarboxylic acids with a certain molar amount of epoxides show excellent lubricity performance and handling properties.

In a first aspect, this invention provides the product obtainable by the reaction of at least one hydrocarbyl-substituted polycarboxylic acid with at least one epoxide, wherein one molar equivalent of carboxylic acid groups is reacted with 0.5 to 1.5 molar equivalents of epoxide groups.

In second and third aspects, this invention provides a process for making the product of the first aspect, comprising the reaction of at least one hydrocarbyl-substituted polycarboxylic acid with at least one epoxide, wherein one molar equivalent of carboxylic acid groups is reacted with 0.5 to 1.5 molar equivalents of epoxide groups, and the product obtained by such a process.

Further aspects of this invention include an additive composition comprising the product of the first or third aspects; an additive concentrate composition comprising either the product of the first or third aspects, or the additive composition, an optionally one or more additional additives, into a mutually-compatible solvent therefor; a fuel oil composition comprising fuel oil and either the product of the first or third aspects, or the additive composition or concentrate composition; an internal combustion engine system containing the fuel oil composition; the use of the product or the additive composition or concentrate to improve the lubricity of a fuel oil; and a method for improving fuel oil lubricity, comprising the addition thereto of the product or additive composition or concentrate composition.

The products defined under the first and third aspects of the invention provide, upon addition to low sulphur fuel oil, an improvement in fuel oil lubricity which can significantly exceed that obtainable from existing lubricity additives, and especially the dimer acid—glycol products disclosed in U.S. Pat. No. 3,287,273. The products also show excellent handleability at low temperature.

DESCRIPTION OF THE PREFERRED EMBODIMENT

The or each acid from which the product is derived is a hydrocarbyl-substituted polycarboxylic acid such as an aliphatic, saturated or unsaturated, straight or branched chain, dicarboxylic acids being preferred. For example, Preferably the dicarboxylic acid is an alkenyl dicarboxylic acid, more preferably containing 2 or (preferably) 1 carbon—carbon double bond. For example, the acid may be generalised by the formula $$R(COOH)_x$$

wherein x (the number of carboxylic acid groups) represents an integer and is 2 or more such as 2 to 4, and R represents a hydrocarbyl group having from 2 to 200 carbon atoms and which is polyvalent corresponding to the value of x, the —COOH groups optionally being substituent on different carbon atoms from one another.

'Hydrocarbyl' means a group containing carbon and hydrogen which group is connected to the rest of the molecule via at least one carbon atom. It may be straight or branched chain which chain may be interrupted by one or more hetero atoms such as O, S, N or P, may be saturated or unsaturated, may be aliphatic or alicylic or aromatic including heterocyclic, or may be substituted or unsubstituted.

The preferred polycarboxylic acids comprise the dimer of one or more unsaturated aliphatic carboxylic acids, such as linoleic acid, oleic acid, linolenic acid or a mixture thereof. It is preferred that the number of carbon atoms between the carboxylic acid groups be in the range of 12 to 42.

the dimer acids used to form the product of the invention are preferably formed from alkenoic monocarboxylic acids. Such acids are extensively described in U.S. Pat. No. 3,287,273 at column 2, line 41 to column 4, line 30, the disclosure of which is incorporated herein as part of the description of this invention. Such acids are commercially available in mixtures of predominantly dimer acid, with minor amounts of trimer and monomer acids also present.

Also preferred are alkenyl-substituted succinic acids wherein the alkenyl substituent preferably contains 10 to 50 carbon atoms, more preferably 18 to 30 carbon atoms.

The epoxide may be of the structure:

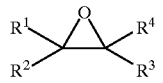

wherein each $R^1$, $R^2$, $R^3$ and $R^4$ is independently selected from hydrogen or a hydrocarbyl group as hereinbefore defined in relation to the acid. Preferably at least two, more preferably at least three, and more preferably all of $R^1$, $R^2$, $R^3$ and $R^4$ are hydrogen, and the remaining group or groups are preferably aryl or alkyl or substituted or interrupted alkyl, such as polyoxalkyl or polyaminoalkyl, or hydroxy- or amino-substituted alkyl groups. Particularly-preferred are 1,2-epoxyethane, and 1-2-epoxypropane.

The product is believed to predominantly comprise the compete ester of the polycarboxylic acid and epoxide. It has been found that compared with the reaction products of dimer acid and glycol described in U.S. Pat. No. 3,287,273, the reaction products of polycarboxylic acid and epoxide show a lesser tendency to oligomerise or polymerise during reaction.

For example, the reaction of an acid dimer with ethylene glycol tends to favour the formation of complex esters consisting of -(diacid-glycol)-$_x$ oligomers, where x is an integer even at stoichiometries of 1:2 (diacid:glycol). In contrast, in reaction with epoxide in the specified ration, oligomer formation is reduced and a different, lower molecular weight product with different electronic character results. Such a product shows improved lubricity performance.

Preferably, one molar equivalent of the carboxylic acid groups present on the acid reactant is reacted with 0.55 to 1.25, more preferably 0.65 to 1.2 (e.g. 0.75 to 1.0) molar equivalents of epoxide groups. In the product, preferably 80% to 100% esterification is achieved. Dicarboxylic acid-based products with an average of 1.8 to 2 ester groups are especially preferred.

A process for making the product is via a ring opening reaction of the reactant carboxylic acid compound with an epoxide, using a basic catalyst such as lithium hydroxide or carbonate, potassium hydroxide or sodium methoxide. Suitable epoxides include 1,2-epoxyethane and 1,2-epoxypropane.

The reaction may be conducted in a suitable solvent, at a temperature below 200° C., preferably below 150° C., for example 120° C., but above 50° C.

The Additive Composition of the Invention

The additive composition defined under the invention is prepared by the incorporation of the product into a composition itself one or more additives for fuel oils. Such incorporation may be achieved by blending or mixing, either with an existing composition or with the components thereof, to produce the additive composition. However, the term 'incorporation' within the meaning of this specification extends not only to the physical mixing of the product with other materials, but also to any physical and/or chemical interaction which may result upon introduction of the product, or upon standing.

Many fuel oil additives are known in the art and may be used to form the composition into which the product is incorporated.

The Additive Concentrate Composition of the Invention

The concentrate may be obtained by incorporating the product or the additive composition into a mutually-compatible solvent therefor. The resulting mixture may be either a solution or a dispersion, but is preferably a solution. Suitable solvents include organic solvents including hydrocarbon solvents, for example petroleum fractions such as naphtha, kerosene, diesel and heating oil; aromatic hydrocarbons such as aromatic fractions, e.g. those sold under the 'SOLVESSO' tradename; paraffinic hydrocarbons such as hexane and pentane and isopariffins; or "bio-solvents", i.e. solvents derived from vegetable oils such as rapeseed methyl ester, or the fuel oil described hereinunder.

Further solvents include oligomers and hydrogenated oligomers of alkenes such as hydrogenated decene-1 dimer or trimer. Also useful are alcohols and esters especially higher alcohols such as liquid alkanols having at least eight carbon atoms. An especially useful solvent is isodecanol. Mixtures of such solvents maybe used in order to produce a mutually-compatible solvent system.

The concentrate may contain up to 80% by weight, for example up to 50%, of solvent.

The concentrate is particularly convenient as a means for incorporating the additive composition into fuel oil where despite the presence of the product, the co-presence of other additives in the composition demands an amount of solvent in order to impart handleability. However, concentrates comprising the product as sole additive may also be used, especially where small quantities of additives are required and the equipment present for introduction of the additive lacks the necessary accuracy to measure or handle such small volumes.

As indicated above, the product and the additive composition and concentrate find particular application in low sulphur fuel oils.

The Fuel Oil

The fuel oil preferably has a sulphur concentration of 0.2% by weight or less based on the weight of the fuel, and preferably 0.05% or less, more preferably 0.03% or less, such as 0.01% or less, most preferably 0.005% or less and especially 0.001% or less. Such fuels may be made by means and methods known in the fuel-producing art, such a solvent extraction, hydrodesulphurisation and sulphuric acid treatment.

As used in this specification, the term "middle distillate fuel oil" includes a petroleum oil obtained in refining crude oil as the fraction between the lighter kerosene and jet fuels fraction and the heavier fuel oil fraction. Such distillate fuel oils generally boil within the range of about 100° C., e.g. 150° to about 400° C. and include those having a relatively high 95% distillation point of above 360° C. (measured by ASTM-D86). In addition, "city-diesel" type fuels, having lower final boiling points of 260–330° C. and particularly also sulphur contents of less than 200 ppm (and preferably 50 ppm and particularly 100 ppm (wt/wt)) are included within the term 'middle distillate fuel oil'.

Middle distillates contain a spread of hydrocarbons boiling over a temperature range, including n-alkanes which precipitate as wax as the fuel cools. They may be characterised by the temperatures at which various %'s of fuel have vaporised ('distillation profile'), e.g. 50%, 90%, 95%, being the interim temperatures at which a certain volume % of initial fuel has distilled. They are also characterised by pour, cloud and CFPP points, as well as their initial boiling point (IBP) and 95% distillation point or final boiling point (FBP). The fuel oil can comprise atmospheric distillate or vacuum distillate, or cracked gas oil or a blend in any proportion of straight run and thermally and/or catalytically cracked distillates. The most common middle distillate petroleum fuel oils are diesel fuels and heating oils. The diesel fuel or heating oil may be a straight atmospheric distillate, or it may contain minor amounts, e.g. up to 35 wt %, of vacuum gas oil or cracked gas oils or of both.

Heating oils may be made of a blend of virgin distillate, e.g. gas oil, naphtha, etc. and cracked distillates, e.g. catalytic cycle stock. A representative specification for a diesel fuel includes a minimum flash point of 38° C. and a 90% distillation point between 282 and 380° C. (see ASTM Designations D-396 and D-975).

As used in this specification, the term 'middle distillate fuel oil' also extends to biofuels, or mixtures of biofuels with middle distillate petroleum fuel oils.

Biofuels, i.e. fuels from animal or vegetable sources are believed to be less damaging to the environment on combustion, and are obtained from a renewable source. Certain derivatives of vegetable oil, for example rapeseed oil, e.g. those obtained by saponification and re-esterification with a monohydric alcohol, may be used as a substitute for diesel fuel. It has been reported that mixtures of biofuels, for example, up to 5:95 or even 10:90 by volume are now commercially available and are useful.

Thus, a biofuel is a vegetable or animal or both or a derivative thereof.

Vegetable oils are mainly trigylerides of monocarboxylic acids, e.g. acids containing 10–25 carbon atoms and of the following formula:

$$\begin{array}{l} CH_2OCOR \\ | \\ CH_2OCOR \\ | \\ CH_2OCOR \end{array}$$

wherein R is an aliphatic radical of 10–25 carbon atoms which may be saturated or unsaturated.

Generally, such oils contain glycerides of a number of acids, the number and kind varying with the source vegetable of the oil.

Examples of oils are rapeseed oil, coriander oil, soyabean oil, cottonseed oil, sunflower oil, castor oil, olive oil, peanut oil, maize oil, almond oil, palm kernel oil, coconut oil, mustard seed oil, beef tallow and fish oils. Rapeseed oil, which is a mixture of fatty acids particularly esterified with glycerol, is preferred as it is available in large quantities and can be obtained in a simple way by pressing from rapeseed.

Examples of derivatives thereof are alkyl esters, such as methyl esters, of fatty acids of the vegetable or animal oils. Such esters can be made by transesterification.

As lower alkyl esters of fatty acids, consideration may be given to the following, for example as commercial mixtures: the ethyl, propyl, butyl and especially methyl esters of fatty acids with 12 to 22 carbon atoms, for example of lauric acid, myristic acid, palmitic acid, palmitoleic acid, stearic acid, oleic acid, petroselic acid, ricinoleic acid, elaeostearic acid, linoleic acid, linolenic acid, eicosanoic acid, gadoleic acid, docosanoic acid or erucic acid, which have an iodine number from 50 to 150, especially 90 to 125. Mixtures with particularly advantageous properties are those which contain mainly, i.e. to at least 50 wt % methyl esters of fatty acids with 16 to 22 carbon atoms and 1, 2 or 3 double bonds. The preferred lower alkyl esters of fatty acids are the methyl esters of oleic acid, linoleic acid, linolenic acid and erucic acid.

Commercial mixtures of the stated kind are obtained for example by cleavage and esterification of natural fats and oils by their transesterification with lower aliphatic alcohols. For production of lower alkyl esters of fatty acids it is advantageous to start from fats and oils with high iodine number, such as, for example, sunflower oil, rapeseed oil, coriander oil, castor oil, soyabean oil, cottonseed oil, peanut oil or beef tallow. Lower alkyl esters of fatty acids based on a new variety of rapeseed oil, the fatty acid component of which is derived to more that 80 wt % from unsaturated fatty acids with 18 carbon atoms, are preferred.

The above described biofuels may be used in blends with middle distillate petroleum fuel oils. Such blends typically contain 0 to 10% by weight of the biofuel and 90 to 100% by weight of the petroleum fuel oil, although other relative proportions may also be used to advantageous effect. Particularly useful are blends of biofuels with 'city-diesel' type fuel oils which exhibit extremely low levels of sulphur and are therefore particularly prone to lubricity problems.

In the fuel oil composition, the concentration of the product incorporated into the oil may for example be in the range of 0.5 to 5,000 ppm of product (active ingredient) by weight per weight of fuel, for example 1 to 1,000 ppm such as 10 to 500 ppm by weight per weight of fuel, preferably 10 to 200 ppm, more preferably 15 to 100 ppm.

In addition to middle distillate fuel oils, other fuels having a need for increased lubricity, such as fuels (e.g. future gasoline) intended for high pressure fuel injection equipment, may suitably be treated with the additives of the invention.

Where the fuel oil composition is produced by incorporation of the additive or concentrate composition, the amount used of each of these compositions will be such as to ensure the incorporation to the fuel oil of the requisite amount of the product. For example, however, the amount of additive or concentrate composition will usually be in the range of 1 to 5,000 ppm (active ingredient) by weight per weight of fuel, especially 10 to 2000 ppm such as 50 to 1,000 ppm.

The invention will now be described further by reference to the examples only as follows:

EXAMPLE 1

Preparation of the Compounds

A Product (A) as defined under the first aspect of the invention was prepared via reaction of a hydrocarbyl-substituted dimer acid mixture with 1,2-epoxyethane (ethylene oxide). The synthetic procedure used is given below. Also prepared was Comparative Product B, made using ethylene glycol (1,2-dihydroxy ethane).

Product A

A commercial mixture of polymerised fatty acids (predominating in the acid dimer with approximately 20% trimer and 2% monomer) (100 g), toluene (100 g) and KOH (1 g) were loaded into a 250 ml autoclave and the vessel was flushed with nitrogen. Heating was started and at 40° C. 16 g of ethylene oxide was added. The mixture was kept at 100° C. until aliquots taken from the mixture attained a constant TAN. After about 24 hours, the TAN has been reduced to 6 from an initial value of 100. The mixture was allowed to cool and the solvent was removed under vacuum. The product recovered was a light yellow liquid.

The product is believed to contain predominantly the diester of the acid dimer.

Product B (Comparative)

In to a glass flask of 250 ml equipped with magnetic stirrer, heating mantle, nitrogen introduction and a Dean-Stark trap was introduced 64.4 gms of the acid mixture used in Product A, 14 gms of glycol and 59 gms of Solvent 20 (known as Esso Solvent 20 DSP 65/95 with a boiling range of 66° C. to 93° C. After homogenisation of the mixture 1.5 of Paratoluenesulfonic acid solution (67 wt % in water) was introduced. The mixture was heated at reflux (70° C.) for one hour without any water being removed.

21 gms of Solvent 20 were then removed from the flask with the boiling point of the mixture increasing to 95–100° C. The mixture was kept under reflux at this temperature for 3 hours and 4 ml of water recovered.

After cooling down, the contents of the flask were introduced to a rotavapor flask and the volatiles removed under vacuum at up to 110° C. The product recovered was a slightly viscous maroon liquid.

EXAMPLE 2

Lubricity Performance

Products A and B were added to a low sulphur middle distillate fuel oil having the following characteristics:

Density at 15° C. 0.8153

Sulfur Content (ppm wt/wt) 4.5

Cetane Number 51.6

Distillation Characteristics (° C.) 10% 205.5
50% 237.1
90% 260.6
Final Boiling Point 294.1

The amounts of each additive used and the results of the HFRR tests are shown in Table 1.

TABLE 1

| Product | Treat Rate (Active Ingredient) | HFRR Wear Scar Diameter ($\mu$m) at 60° C. |
|---|---|---|
| A (Invention) | 125 ppm wt/wt | 454 |
| B (Comparative) | 125 ppm wt/wt | 577 |

In conclusion, it can be seen that Product A was surprisingly more potent as a lubricity additive than Product B.

What is claimed is:

1. A method for improving the lubricity of a fuel oil having a sulfur content of 0.05% by weight or less which comprises the addition to said fuel of from 0.5 to 5000 ppm by weight per weight fuel of the reaction product of at least one hydrocarbyl substituted polycarboxylic acid with at least one epoxide, wherein the polycarboxylic acid is selected from the group consisting of the dimer or one more alkenyl carboxylic acids wherein the number of carbon atoms between the carboxylic acid groups is 12 to 42 or an alkenyl-substituted succinic acid having from 18 to 30 carbon atoms and wherein said reaction product has an average of 1.8–2 ester groups.

2. The method of claim 1 wherein the dimer is the dimer of linoleic acid, oleic acid, linolenic acid or a mixture thereof.

3. The method of claim 1 wherein at least one epoxide is 1,2-epoxyethane.

* * * * *